US009278818B2

(12) United States Patent
Nagai

(10) Patent No.: US 9,278,818 B2
(45) Date of Patent: Mar. 8, 2016

(54) MEDIUM SUPPLY DEVICE AND IMAGE FORMING APPARATUS

(71) Applicant: Oki Data Corporation, Tokyo (JP)

(72) Inventor: Hitoshi Nagai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 27 days.

(21) Appl. No.: 13/684,778

(22) Filed: Nov. 26, 2012

(65) Prior Publication Data

US 2013/0134658 A1 May 30, 2013

(30) Foreign Application Priority Data

Nov. 28, 2011 (JP) ..... 2011-258926

(51) Int. Cl.
*B65H 1/00* (2006.01)
*B65H 1/04* (2006.01)
*B65H 1/26* (2006.01)

(52) U.S. Cl.
CPC .. *B65H 1/00* (2013.01); *B65H 1/04* (2013.01); *B65H 1/266* (2013.01); *B65H 2511/00* (2013.01); *B65H 2511/10* (2013.01); *B65H 2511/12* (2013.01); *B65H 2511/182* (2013.01); *B65H 2551/14* (2013.01); *B65H 2701/1131* (2013.01); *B65H 2801/06* (2013.01)

(58) Field of Classification Search
CPC .... B65H 1/00; B65H 1/04; B65H 2405/1122; B65H 2405/1134; B65H 2405/11425; B65H 2405/1144; B65H 11/00; B65H 11/10; B65H 11/12; B65H 11/18; B65H 11/182; B65H 11/40; B65H 2701/1131; B65H 1/266; B65H 2551/14
USPC ..... 271/145, 223, 171, 9.06
See application file for complete search history.

(56) References Cited

U.S. PATENT DOCUMENTS 5,572,310 A * 11/1996 Hoberock ..... B65H 1/266 271/145
5,839,047 A * 11/1998 Hirabayashi ..... B65H 1/04 271/171
6,826,383 B2 * 11/2004 Yano ..... B65H 1/266 271/144
2012/0299237 A1 * 11/2012 Mizuguchi ..... B65H 1/266 271/145

FOREIGN PATENT DOCUMENTS

JP 01256428 A * 10/1989
JP 02276728 A * 11/1990
JP 08-034525 A 2/1996
JP 10-109763 A 4/1998
JP 11-059920 A 3/1999
JP 2001-002261 A 1/2001
JP 2004-250113 A 9/2004

* cited by examiner

*Primary Examiner* — Prasad Gokhale
(74) *Attorney, Agent, or Firm* — Muncy, Geissler, Olds & Lowe, P.C.

(57) ABSTRACT

A medium supply device includes a medium cassette that accommodates a medium, a dial that is rotatable around a predetermined rotation shaft, an angle-holding part to hold the dial, a subsidiary arm including arm parts that are independently displaceable, and a detection switch with switch parts that are pressed by arm parts of the subsidiary arm. The dial includes a display part on which display elements illustrating a medium size are arranged in a circumferential direction around the rotation shaft, a rotation lock part configured to be locked by the angle-holding part, and a projection formation part that includes projection parts configured to press the arm parts of the subsidiary arm in a circumferential direction around the rotation shaft. The projection parts selectively contact and displace the arm parts in accordance with the rotation angle of the dial to selectively press the switch parts of the detection switch.

20 Claims, 18 Drawing Sheets

Fig. 12

| | Medium Size Setting | S1 | S2 | S3 | S4 |
|---|---|---|---|---|---|
| No Casette | No Casette | OFF | OFF | OFF | OFF |
| 0 Degree Rotation | OTHER | ON | ON | OFF | ON |
| 24 Degree Rotation | TABLOID | OFF | ON | ON | OFF |
| 48 Degree Rotation | LEGAL | OFF | OFF | ON | ON |
| 72 Degree Rotation | LETTER Portrait | ON | OFF | OFF | ON |
| 96 Degree Rotation | LETTER Landscape | OFF | ON | OFF | OFF |
| 120 Degree Rotation | EXEC | OFF | OFF | ON | OFF |
| 144 Degree Rotation | B4 | OFF | OFF | OFF | ON |
| 168 Degree Rotation | B5 Portrait | ON | OFF | OFF | OFF |
| 192 Degree Rotation | B5 Landscape | ON | ON | OFF | OFF |
| 216 Degree Rotation | A3 | ON | ON | ON | OFF |
| 240 Degree Rotation | A4 Portrait | ON | ON | ON | ON |
| 264 Degree Rotation | A4 Landscape | OFF | ON | ON | ON |
| 288 Degree Rotation | A5 Portrait | ON | OFF | ON | ON |
| 312 Degree Rotation | A5 Landscape | OFF | ON | OFF | ON |
| 336 Degree Rotation | A6 | ON | OFF | ON | OFF |

MEDIUM SUPPLY DEVICE AND IMAGE FORMING APPARATUS

CROSS REFERENCE TO RELATED APPLICATION

The present application is related to, claims priority from and incorporates by reference Japanese Patent Application No. 2011-258926, filed on Nov. 28, 2011.

TECHNICAL FIELD

The present invention relates to a medium supply device (e.g. sheet supply device) that has a function to detect of medium sizes, and an image forming apparatus.

BACKGROUND

Conventionally, in an image forming apparatus, a sheet size detection mechanism is used so that sizes of sheets that are accommodated in a sheet supply cassette are recognized on an apparatus main body side.

The conventional sheet size detection mechanism includes a signal output drum provided in the sheet supply cassette. The signal output drum includes a plurality of projections in an axial direction thereof. In addition, a plurality of detection levers are located in the apparatus main body to which the sheet supply cassette is installed to face the plurality of projections of the signal output drum (see JP Laid-Open Patent Application No. H8-34525 (e.g. see columns 0013, 0014, FIGS. 6 and 7).

However, in the above-discussed conventional art, since the plurality of projections and the plurality of detection levers are each arranged in the axial direction of the signal output drum, when a setting number of the sheet sizes increases, a size of the signal output drum in the axial direction needs to increase, which results in the prevention of downsizing of the apparatus main body.

SUMMARY

A medium supply device of one of the present inventions disclosed in the application includes a medium cassette that accommodates a medium and that is installed into a predetermined installation part; a dial that is provided on the medium cassette and that is rotatable around a predetermined rotation shaft; an angle-holding part that is configured to hold the dial at a predetermined rotation angle; a subsidiary arm that is provided to face the dial of the medium cassette that is installed on the installation part and that includes a plurality of arm parts that are independent of each other and that are independently displaceable; and a detection switch that includes a plurality of switch parts that are pressed by the plurality of arm parts of the subsidiary arm. The dial includes a display part on which a plurality of display elements that illustrate a medium size are arranged in a circumferential direction around the rotation shaft, a rotation lock part that is configured to be locked by the angle-holding part, and a projection formation part that includes a plurality of projection parts configured to press the plurality of arm parts of the subsidiary arm in a circumferential direction around the rotation shaft, and the projection parts of the projection formation part selectively contact and displace the arm parts of the subsidiary arm in accordance with the rotation angle of the dial to selectively press the switch parts of the detection switch.

According to the present invention, the medium supply device that has the function to detect of the medium size and that is possible to be downsized and the image forming apparatus are realized.

BRIEF DESCRIPTION OF THE DRAWINGS

FIG. 12 illustrates setting examples of medium sizes according to the first embodiment.

DESCRIPTION OF EMBODIMENTS

First Embodiment

Figure 1:
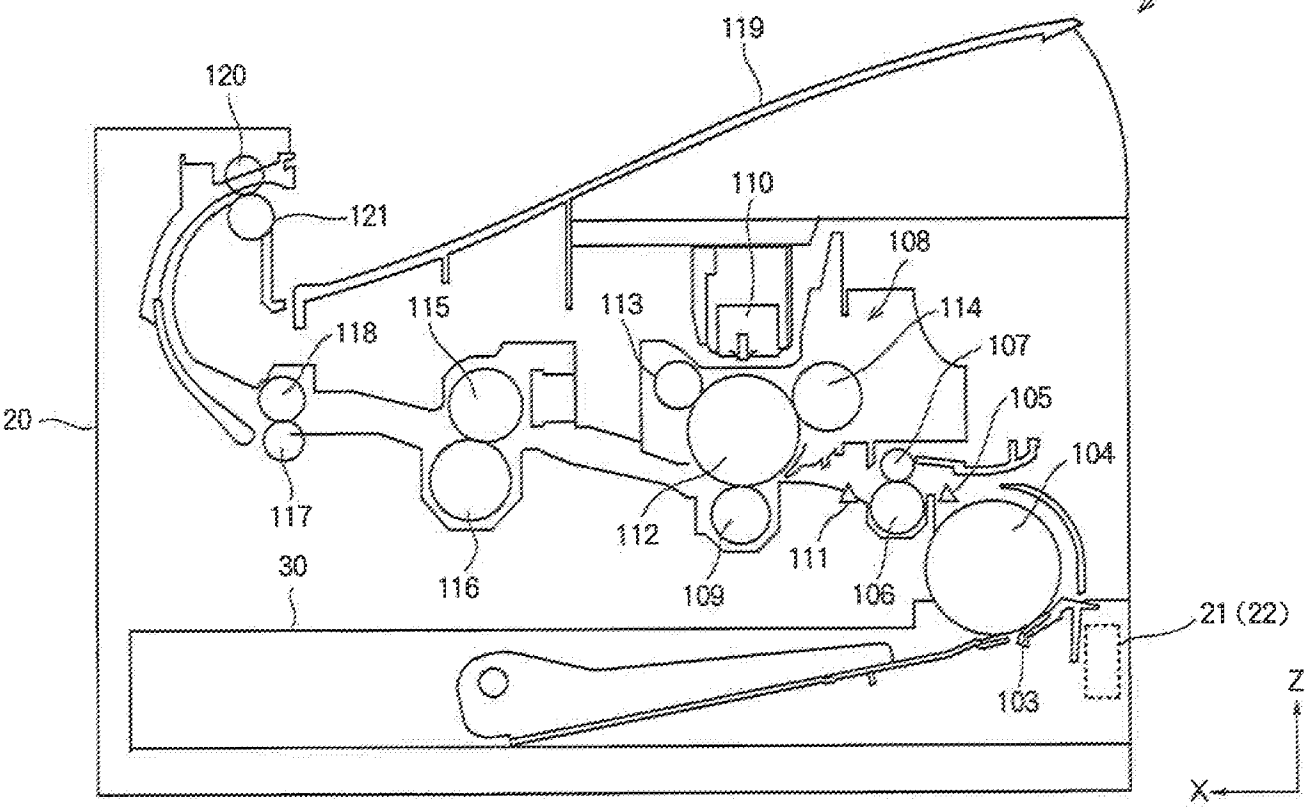
FIG. 1 illustrates an entire configuration of an image forming apparatus according to a first embodiment of the present invention.

A configuration of an image forming apparatus according to a first embodiment of the present invention is explained with reference to FIG. 1. FIG. 1 illustrates an entire configuration of an image forming apparatus 10 according to the first embodiment. The sheet supply cassette 30 as a medium cassette that accommodates media such as recording media is removably installed into a lower part of the image forming apparatus 10.

A part in the image forming apparatus 10 except the removable sheet supply cassette 30 is referred to as an apparatus main body 20. A detection switch 21 for detecting a size of the media that are accommodated in the sheet supply cassette 30 and a subsidiary arm 22 is provided on the apparatus main body 20. The detection switch 21 and subsidiary arm 22 are discussed later.

A feed roller 104 and a separation piece 103 (medium supply part) for sending each of the media accommodated in the sheet supply cassette 30 to a carrying path are provided on the upper side of the sheet supply cassette 30. A sheet supply sensor 105 for detecting that a medium has been fed is provided on the downstream side (hereinafter, simply referred to as the downstream side) along the carrying path of the medium sent by the feed roller 104 and the separation piece 103. In addition, a registration roller 106 and a pressure roller 107 (medium carry part) that redress the skew of the medium and carry the medium are located on the downstream side of the sheet supply sensor 105.

An image forming part 108 that forms a toner image (developer image) is located on the downstream side of the registration roller 106 and the pressure roller 107. A print head (exposure device) 110 that forms an electrostatic latent image on a photosensitive body (e.g. photosensitive drum, discussed later) 112 of the image forming part 108 is located above the image forming part 108. A transfer roller (transfer part) 109 that transfers the toner image formed in the image forming part 108 to the medium is located at the lower part of the image forming part 108. In addition, a passage sensor 111 for deciding the timing when the formation of the toner image starts is provided on the upstream side of the image forming part 108.

The image forming part 108 includes the photosensitive drum 112 as an electrostatic latent image carrier, a charge roller 113 as a charge member that uniformly charges the photosensitive drum 112 to a predetermined potential (e.g. negative potential) and the development roller 114 as a developer carrier that develops the electrostatic latent image formed on the photosensitive drum 112 by the above-described print head 110 to form the toner image.

A fuser device that fixes the toner image transferred onto the medium to the medium is located on the downstream side of the image forming part 108. The fuser device includes a heat roller 115 and a backup roller 116 that sandwich the medium to apply heat and pressure to the medium.

An ejection roller (face-up ejection roller) 117 and a driven roller 118 that carry the medium on which the toner image is fixed are located on the downstream side of the fuser device. An ejection roller 120 and a driven roller 121 that eject the medium to an ejection stacker 119 provided on the upper part of the apparatus main body 20 are provided on the further downside of the ejection roller 117 and the driven roller 118.

Next, a configuration for detecting the size of the media accommodated in the sheet supply cassette 30 on the apparatus main body 20 side is explained. As described above, the sheet supply cassette 30 that accommodates the media is installed into the lower part (installation part) of the apparatus main body 20 of the image forming apparatus 10.

Here, the horizontal surface is defined as a XY surface, and the vertical direction is defined as a Z direction. In the XY surface, an insert direction of the sheet supply cassette 30 is defined as an X direction. In particular, a direction in which the sheet supply cassette 30 is inserted in the apparatus main body 20 is defined as a +X direction, and a direction in which the sheet supply cassette 30 is removed from the apparatus main body 20 is defined as a −X direction. In addition, in the XY surface, a direction orthogonal to the X direction is defined as a Y direction. The Y direction is parallel to a shaft direction of the photosensitive drum 112, the development roller 114 and the like of the image forming part 108.

Figure 2:
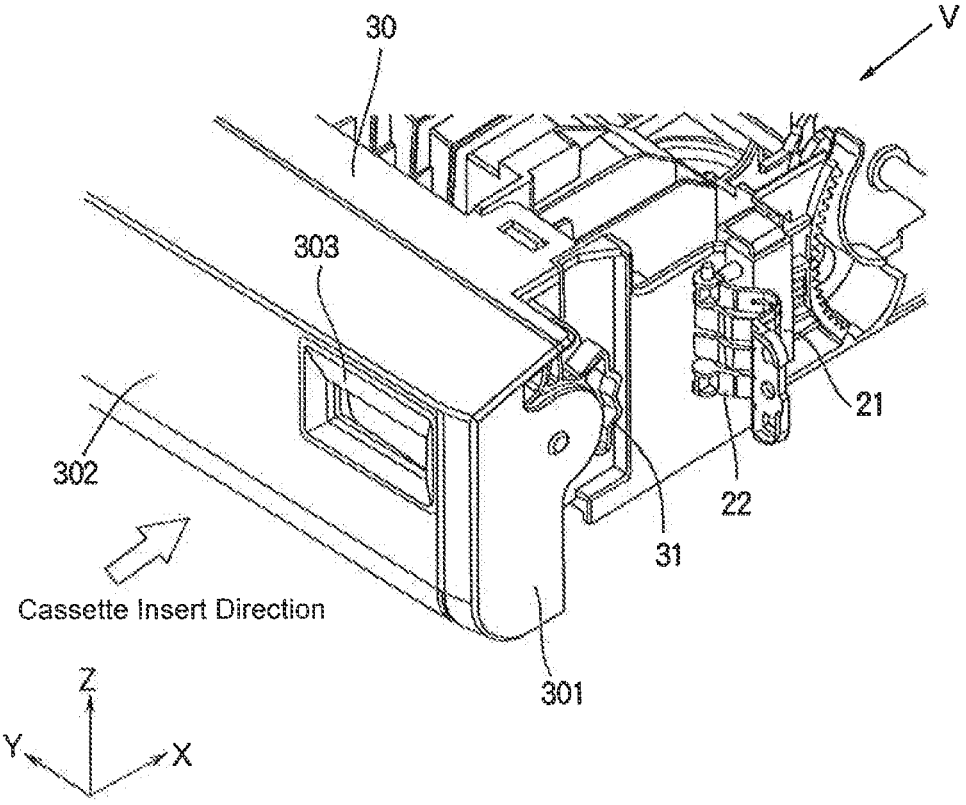
FIG. 2 is a perspective view of a medium size detection part according to the first embodiment.
Figure 3:
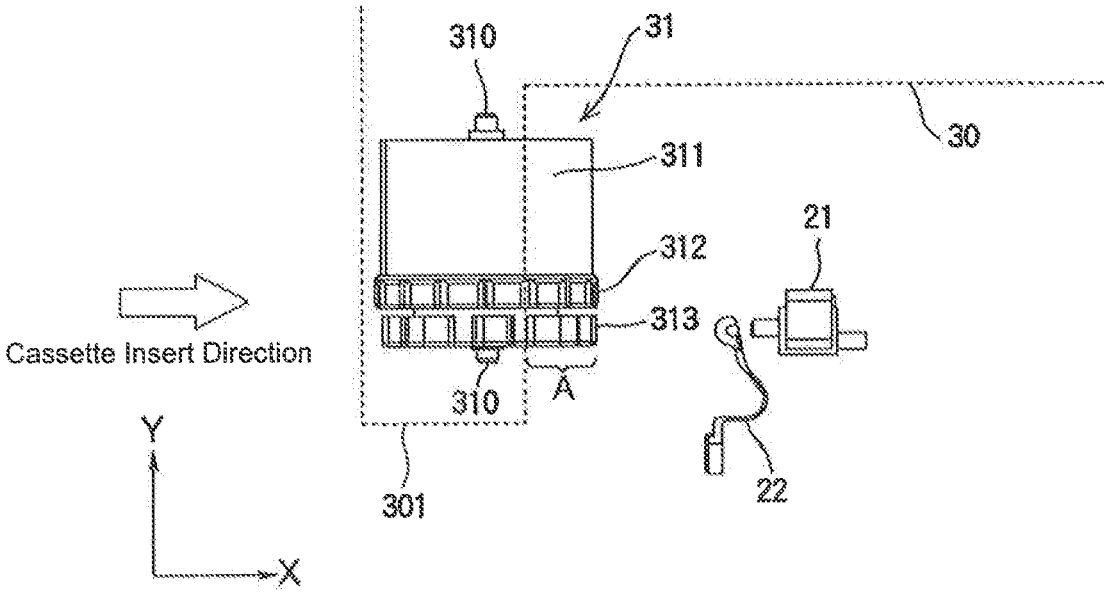
FIG. 3 is a top view of the medium size detection part according to the first embodiment.

FIGS. 2 and 3 are a perspective view and a top view of a medium size detection part according to the first embodiment. The medium size detection part includes a dial 31 that is provided on the sheet supply cassette 30 for the detection of the medium size, and a detection switch 21 and the subsidiary arm 22 that are provided on the apparatus main body 20.

The sheet supply cassette 30 includes a grabbing part 301 on a front side of the insert direction thereof (+X direction) that a user grabs when the user installs and removes the sheet supply cassette 30. The grabbing part 301 has a shape in which the grabbing part 301 expands in both sides of the sheet supply cassette 30 in the width direction (Y direction). The dial 31 is attached at a part in which the grabbing part 301 expands. A part of the dial 31 (indicated by reference number A in FIG. 3) protrudes in +X direction from the grabbing part 301, and is exposed outside.

The detection switch 21 and the subsidiary arm 22 are provided on the apparatus main body 20 to face the dial 31 of the sheet supply cassette 30 in the X direction.

Figure 4:
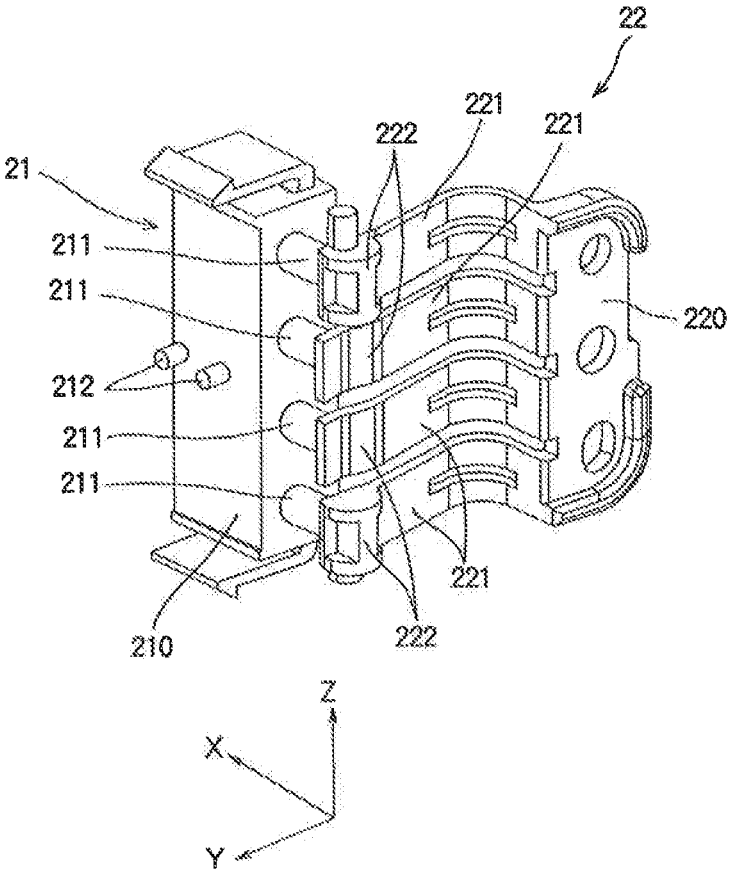
FIG. 4 is a perspective view of a detection switch and a subsidiary arm according to the first embodiment.

FIG. 4 is a perspective view of the detection switch 21 and the subsidiary arm 22. The detection switch 21 includes n (herein, 4) switch levers 211 as switch parts arranged in a row in the Z direction. The switch levers 211 are attached to a switch support body 210 that extends in the Z direction.

Each of the switch levers 211 are configured to be pushed in the X direction (insert direction of the sheet supply cassette 30). Pushing any of the switch levers 211 (i.e. which switches of switches S1 to S4 discussed later are ON state) is detected via output signals from terminal parts 212 attached to a switch support body 210.

There are $2^n$ (herein, 16) types of detectable combinations of pushing of the n switch levers 211. Up to $(2^n-1)$, (herein, 15) types of medium sizes can be detected since a state in which none of the n switch levers 211 are pushed represents a state in which the sheet supply cassette 30 is not installed.

The subsidiary arm 22 assists the pushing of the n switch levers 211 of the detection switch 21. Specifically, the subsidiary arm 22 includes the n arm parts 221 that, respectively, correspond to each of the switch levers 211 of the detection switch 21 and an arm support body 220 that integrally holds the arm parts 211.

Each of the arm parts 221 extends in the +X direction from the arm support body 220, further curves and extends in the Y direction, and front edge parts thereof reach the switch levers 211. Each of the arm parts 221 is configured by a material that is elastically deformable (bending deformation), and is displaced in a direction in which the switch levers 211 are pushed.

Later-discussed contact parts 222 that contact the dial 31 are formed at each of the front edge parts of the arm parts 221. The contact parts 222 preferably have a shape that is convex on a side opposite to the detection switch 21. When one or more arm parts 221 of the n (herein, 4) arm parts 221 are pressed by the dial 31, the pressed arm parts 221 bend to push the switch levers 211 to which the pressed arm parts correspond.

Figure 5:
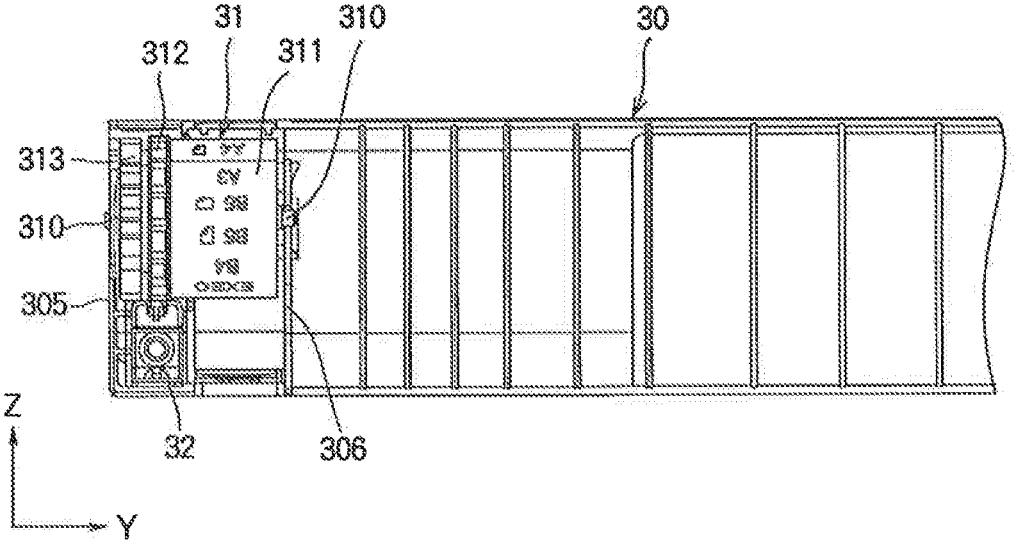
FIG. 5 illustrates a dial attachment part of a sheet supply cassette according to the first embodiment.
Figure 6:
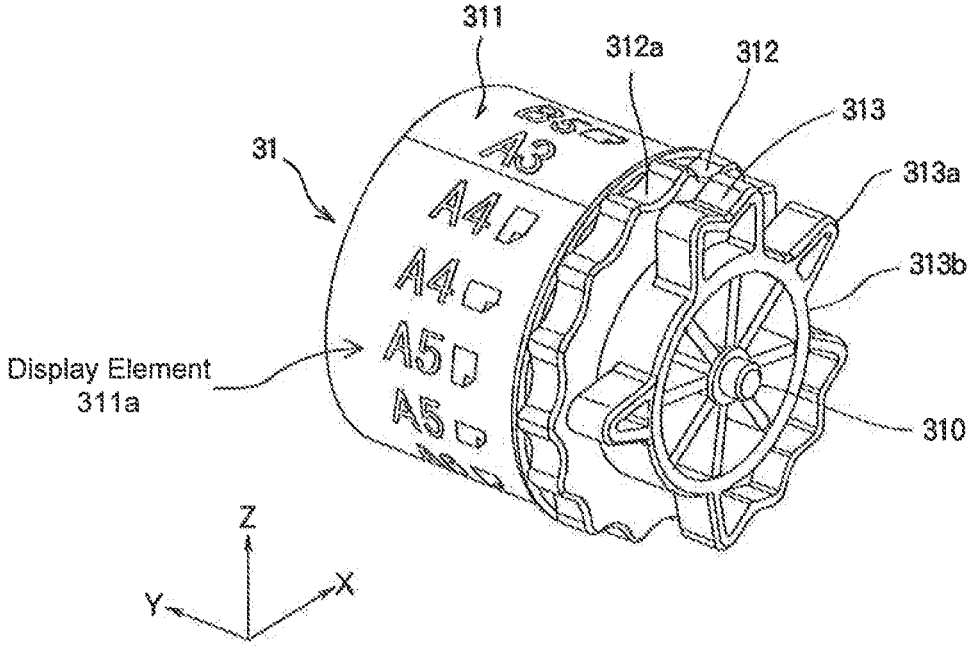
FIG. 6 is a perspective view of a configuration of a dial according to the first embodiment.

FIG. 5 illustrates an attachment part of the dial 31 in the sheet supply cassette 30, and corresponds to a view viewed from a direction of an arrow V illustrated in FIG. 2. FIG. 6 is a perspective view of the dial 31. The dial 31 is a substantially cylindrical member, and a center shaft 310 that functions as a rotation shaft thereof is rotatably supported by wall parts 305 and 306 (FIG. 5) of the sheet supply cassette 30.

The dial 31 is configured by combining a cylindrical display part 311, a substantially disk-shaped rotation lock part 312 and a substantially disk-shaped dial projection part (projection formation part) 313 together on the same axis. These integrally rotate around the above-discussed center shaft 310.

As shown in FIG. 6, the display part of the dial 31 is a cylindrical member, and a plurality of display elements 311*a* that illustrate the sizes of the media are arranged on the periphery surface thereof at an even interval. Here, the display elements 311*a* of the sizes such as A4, A5, B5 and the like are put on each of parts of the periphery surface of the display part 311 that are equally divided in the circumferential direction by $(2^n-1)$ (15 divisions in the case of n=4).

Figure 7:
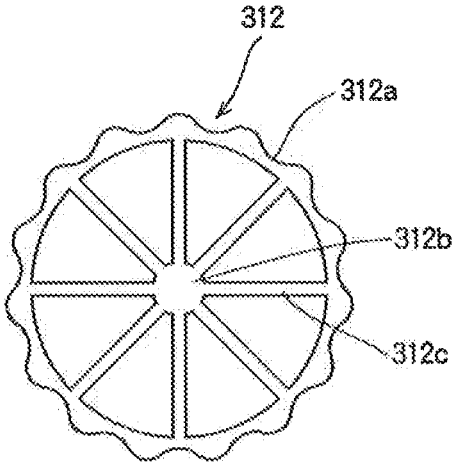
FIG. 7 illustrates a shape of a rotation lock part according to the first embodiment.

FIG. 7 illustrates the rotation lock part 312 of the dial 31. The rotation lock part 312 locks the dial 31 at a predetermined rotation angle (rotation position), and $(2^n-1)$, (herein, 15) concave parts 312*a* are arranged as engaged parts on the periphery surface thereof, which is substantially along the above-discussed periphery surface of the display part 311, in the circumferential direction at an even interval.

The rotation lock part 312 is locked at any one of $(2^n-1)$ types of rotation angles by the angle-holding member 32 located in the sheet supply cassette 30. A configuration of the angle-holding member 32 is discussed later.

Figure 8:
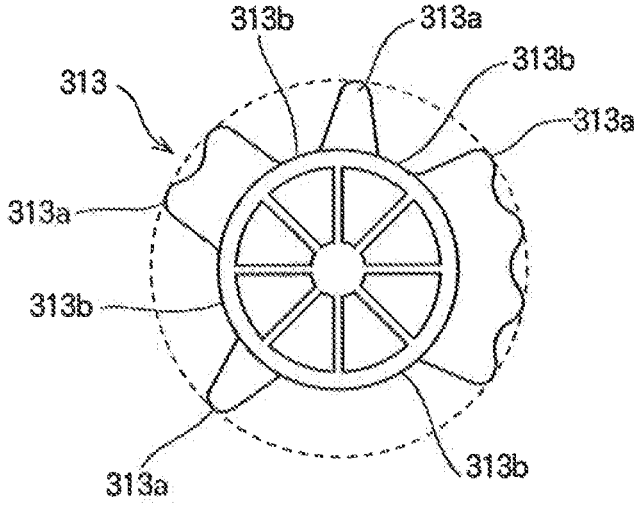
FIG. 8 illustrates a shape of a dial projection part according to the first embodiment.

FIG. 8 illustrates a configuration of the dial projection part 313. The dial projection part 313 selectively contacts each of the n (herein, 4) arm parts 221 (FIG. 4) of the subsidiary arm 22, and selectively pushes each of the n switch levers 211 of the detection switch 21 via each of the arm parts 221.

In particular, the dial 31 has a shape that presses each of the n (herein, 4) arm parts 221 of the subsidiary arm 22 with $(2^n-1)$, (herein, 15) types of combinations in accordance with the rotation angles.

The projection parts 313*a* (convex part) and depression parts 313*b* (concave part) are arranged on the dial projection part 313 in the circumferential direction at intervals of $(2^n-1)/360$ degrees (herein, 24 degrees) as illustrated in Table 1 discussed below, for example. Regarding angles illustrated in Table 1, the projection part 313*a* positioned at the highest in FIG. 8 is defined as a reference (0 degrees).

By configuring as described above, the dial projection part 313 pushes each of the n (herein, 4) arm parts 221 of the subsidiary arm 22 with all of the $(2^n-1)$, (herein, 15) types of combinations. Specific combinations are discussed later.

TABLE 1

| Degree | 0° | 24° | 48° | 72° | 96° | 120° | 144° | 168° |
|---|---|---|---|---|---|---|---|---|
| concave/convex | convex | concave | convex | convex | convex | convex | concave | concave |
| Degree | 192° | 216° | 240° | 264° | 288° | 312° | 336° | 360° |
| concave/convex | concave | convex | concave | concave | convex | convex | concave | — |

Figure 9:
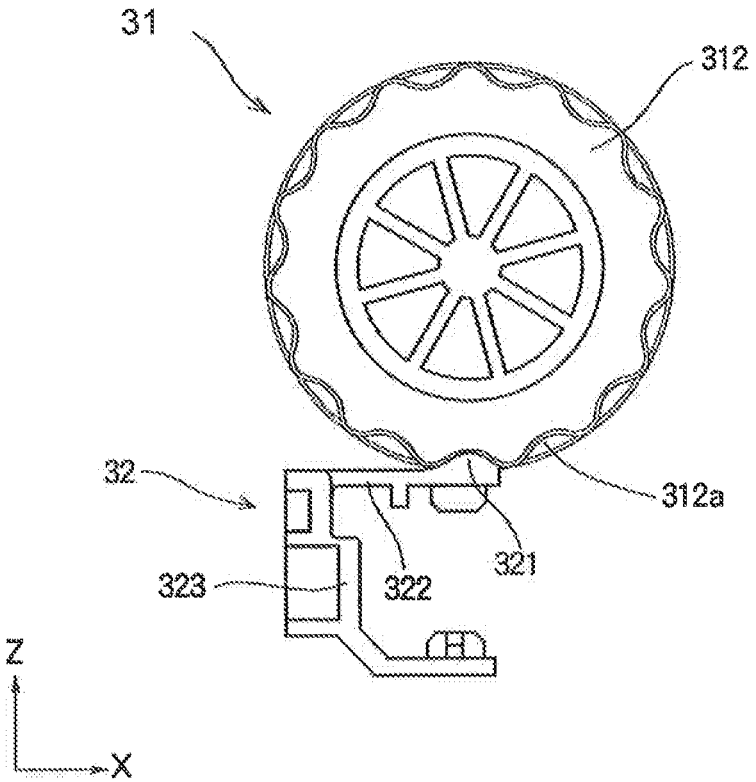
FIG. 9 is a side view of the dial and an angle-holding member according to the first embodiment.

FIG. 9 is a side view of the rotation lock part 312 of the dial 31 and the angle-holding member (angle-holding part) 32 located in the lower side of the dial 31. The angle-holding member 32 includes an engagement part 321 (convex part) that is engageable with the engaged parts 312*a* of the rotation lock part 312 of the dial 31. The engagement part 321 is attached on an end part of a support body 322 that extends in the X direction. A distal end of the support body 322 is attached to an attachment member 323 fixed on a bottom plate of the sheet supply cassette 30.

The support body 322 of the angle-holding member 32 is elastically deformable (bendable), and biases the engagement part 321 in a direction in which the engagement part 321 engages with the engaged part 312*a* of the dial 31. The engagement part 321 of the angle-holding member 32 engages with any one of the $(2^n-1)$, (herein, 15) engaged parts 312*a* that are formed on the dial 31 at an even interval. Thereby, the dial 31 is held at one of the $(2^n-1)$, (herein, 15) types of rotation angles.

Figure 10:
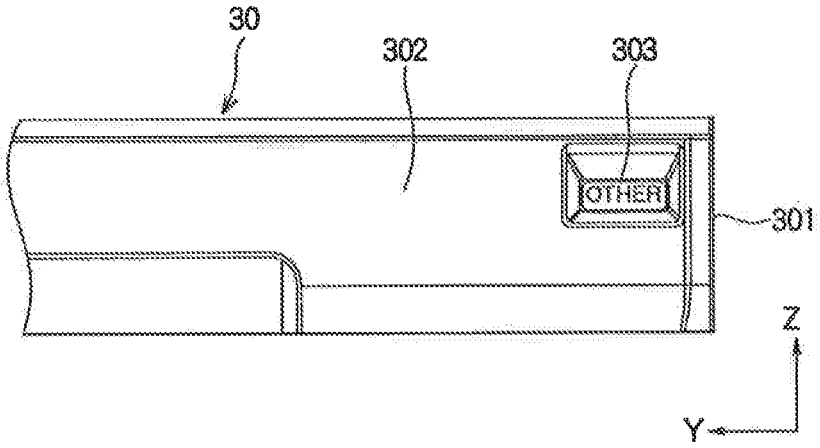
FIG. 10 is a front view of the sheet supply cassette according to the first embodiment.

FIG. 10 is a front view of the sheet supply cassette 30. An opening part (confirmation hole) 303 is formed on a front surface part 302 of the grabbing part 301 of the sheet supply cassette 30, and at a position in which the opening part 303 faces the display part 311 of the dial 31. Thereby, any one of the $(2^n-1)$ types of media displayed on the display part 311 of the dial 31 that is selected is visibly presented through the opening part 303 from outside of the sheet supply cassette 30.

A medium supply device (sheet supply device) is configured by the sheet supply cassette 30 (including the dial 31 and the angle-holding member 32) configured as described above, the detection switch 21, and the subsidiary arm 22.

Figure 11:
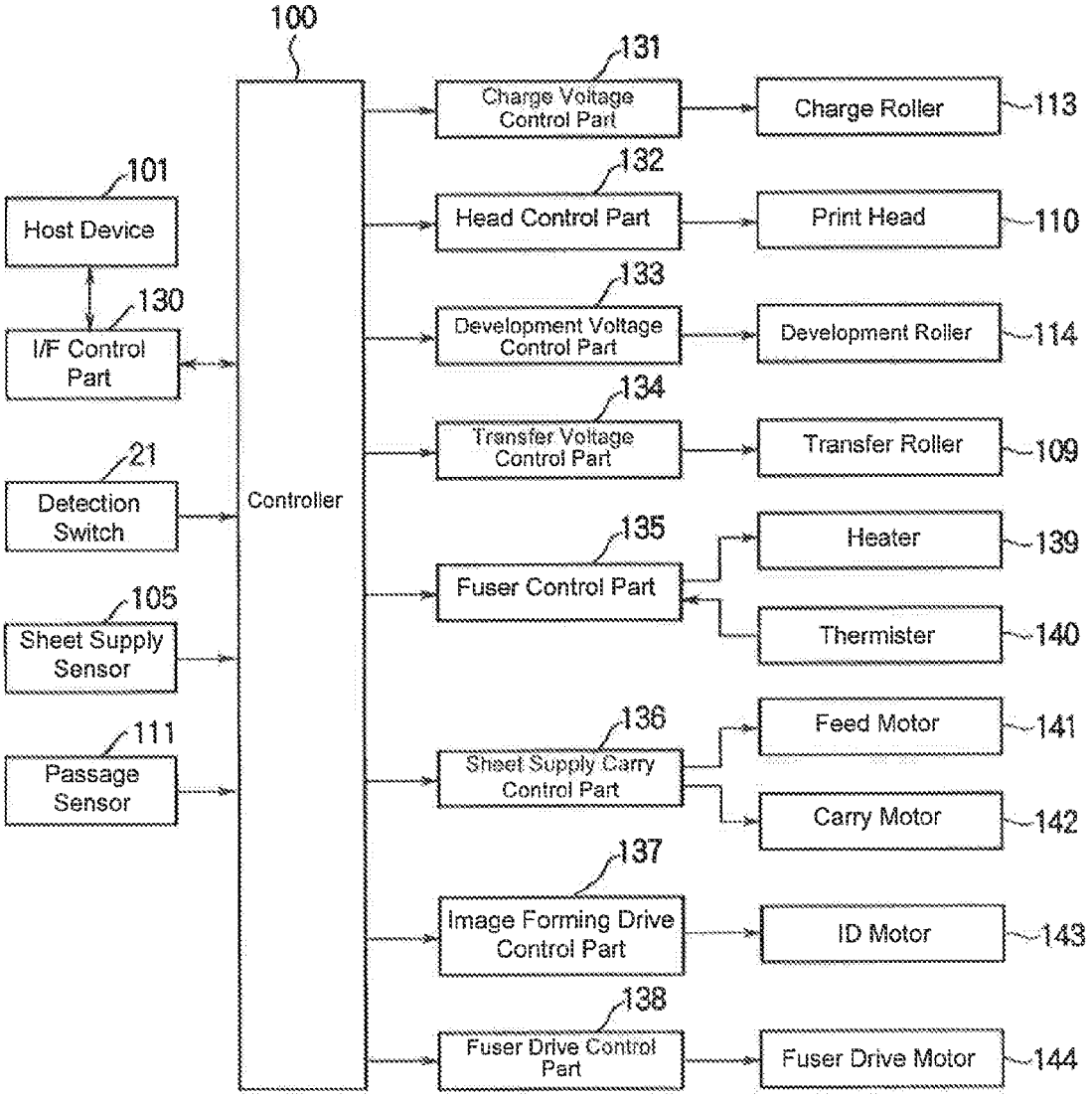
FIG. 11 is a block diagram of a control system of the image forming apparatus according to the first embodiment.

FIG. 11 is a block diagram of a control system of the image forming apparatus 10. A controller 100 (decision part) that is responsible for a control of the image forming apparatus 10 is configured with a microprocessor, a read-only memory (ROM), a random access memory (RAM), an input/output port, a timer and the like, receives print data and a control command from a host device 101 such as a personal computer and the like, and performs a sequential control of the image forming apparatus.

An interface (I/F) control part 130 sends information (printer information and the like) of the image forming apparatus 10 to the host device 101, analyzes a command sent from the host device 101, and processes the data sent from the host device 101.

A charge voltage control part 131 applies a charge voltage to the charge roller 113 of the image forming part 108 in accordance with an instruction from the controller 100 to uniformly charge the entire surface of the photosensitive drum 112 of the image forming part 108.

A head control part 132 drives the print head 110 according to the print data in accordance with an instruction from the controller 100 to expose the surface of the photosensitive drum 112 for forming the electrostatic latent image.

A development voltage control part 133 applies a development voltage to the development roller 114 of the image forming part 108 in accordance with an instruction from the controller 100 to develop the electrostatic latent image on the photosensitive drum 112.

A transfer voltage control part 134 applies a transfer voltage to the transfer roller 109 in accordance with an instruction from the controller 100 to transfer the toner image formed on the surface of the photosensitive drum 112 to the medium.

A fuser control part 135 controls to turn an application of a current to a heater 139 contained in the heat roller 115 on and off based on a detection temperature from a thermister 140 that detects a temperature of the fuser device (115, 116).

A sheet supply carry control part 136 performs a control for driving a feed motor 141 and a carry motor 142 in accordance with an instruction from the controller 100. The feed motor 141 rotatably drives the feed roller 104. The carry motor 142 rotatably drives the carrying roller 106, the ejection rollers 117 and 120.

An image forming drive control part 137 drives an image drum (ID) motor 143 that rotates the photosensitive drum 112 and the development roller 114 in accordance with an instruction from the controller 100. The charge roller 113 is driven to rotate following the photosensitive drum 112.

A fuser drive control part 138 drives a fuser drive motor 144 that rotates the heat roller 115 in accordance with an instruction from the controller 100. The backup roller 116 is driven to rotate following the heat roller 115.

Furthermore, detection signals from the detection switch 21, that is, ON/OFF signals of the n switch levers 211 are input to the controller 100. The controller 100 corresponds to a decision part that determines the medium size in the sheet supply cassette 30 based on the detection signals from the detection switch 21.

Next, an operation of the image forming apparatus 10 is explained with reference to FIG. 1 and FIG. 11.

When the controller 100 of the image forming apparatus 10 receives a print instruction and print data from the host device 101, the controller 100 starts an image forming operation. Firstly, the sheet supply carry control part 136 drives the feed motor 141. The feed roller 104 rotates and sends the medium in the sheet supply cassette 30 to the carrying path.

The medium sent to the carrying path by the feed roller 104 passes the sheet supply sensor 105, and reaches to a nip part of the registration roller 106 and the pressure roller 107. The sheet supply carry control part 136 drives the carrying motor 142 based on the detection signal of the sheet supply sensor 105 at the predetermined timing, and the registration roller 106 and the pressure roller 107 start to rotate. The medium is carried toward the image forming part 108 after a skew of the medium is redressed by the registration roller 106 and the pressure roller 107. The medium passes the passage sensor 111 and reaches the image forming part 108.

The controller 100 performs the formation of the toner image in the image forming part 108 based on the detection signal of the passage sensor 111 as described below.

That is, the ID motor 143 is driven by the image forming drive control part 137, and the photosensitive drum 112 and the development roller 114 rotate. The charge voltage is applied to the charge roller 113 by the charge voltage control part 131. The charge roller 113 is driven to rotate following the photosensitive drum 112, and uniformly charges the surface of the photosensitive drum 112. Furthermore, the print head 110 is driven by the head control part 132, and exposes the surface of the photosensitive drum 112 to form the electrostatic latent image. In addition, the development voltage is applied to the development roller 114 by the development voltage control part 133, and the development roller 114 develops the electrostatic latent image on the surface of the photosensitive drum 112 with toner to form the toner image.

The transfer voltage is applied to the transfer roller 109 by the transfer voltage control part 134, and the toner image on the surface of the photosensitive drum 112 is transferred to the medium when the medium passes a nipping part between the photosensitive drum 112 and the transfer roller 109.

The medium on which the toner image is transferred is carried to the fuser device (115, 116). Heat and pressure are applied to the toner image which is transferred onto the medium by the heat roller 115 and the backup roller 116, and the toner image is fixed on the medium. The medium on which the toner image is fixed is carried by the ejection roller 117 and the driven roller 118 as well as the ejection roller 120 and the driven roller 121, and is ejected on the ejection stacker 119.

Next, setting and detection of the medium size are explained. As described above, the detection switch 21 includes the n (herein, 4) push-type switch levers 211, and $(2^n-1)$ types of medium sizes can be set in accordance with the combinations of pushing of the switch levers 211.

FIG. 12 illustrates setting examples of the medium sizes in the case of n=4. In FIG. 12, "OTHER" means a nonstandard sized sheet. "TABLOID" means a 279.0 mm×432.0 mm of sheet. "LEGAL" means a 215.9 mm×355.6 mm of sheet. In addition, "LETTER" means a 215.9 mm×279.4 mm of sheet. "EXEC" means a 184.15 mm×266.7 mm of sheet. A3, A4, A5, A6, B4 and B5 are examples of sheet sizes A and B defined under the JIS P 0202 standard.

In addition, for media of which feeding directions are selectable, the medium sizes and the feeding directions are combined and set. "Portrait" means that media are set to be carried in a longitudinal direction thereof. "Landscape" means that the media are set to be carried in a width (lateral) direction thereof.

All of the $(2^n-1)$ types of medium sizes (feeding directions are also included) are displayed on the display part 311 of the dial 31. In a state before the installation of the sheet supply cassette 30 to the apparatus main body 20, the user touches an exposure part (part indicated by the reference number A in FIG. 3) of the dial projection part 313, and rotates the dial 31 to select a size of the media.

Here, the case when "OTHER" is selected in the dial 31 is explained. At this case, the user rotates the dial 31 at a rotation angle in which the display "OTHER" is seen from the opening part 303 of the sheet supply cassette 30 (FIG. 10). The dial 31 is held at this rotation angle by the angle-holding member 32.

Figure 13:
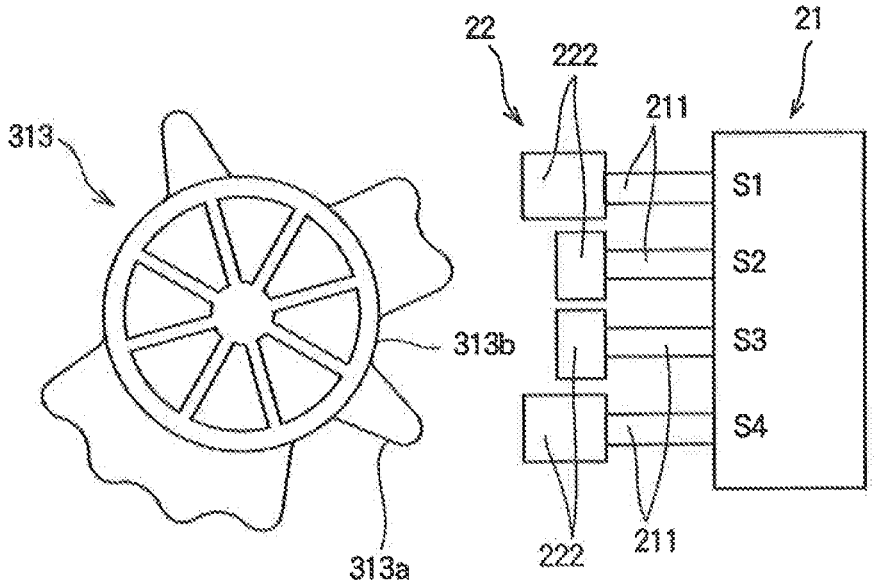
FIG. 13 illustrates the relationship among the dial, the detection switch, and the subsidiary arm before the sheet supply cassette is installed into the apparatus main body.

FIG. 13 illustrates the relationship among the dial 31, the detection switch 21 and the subsidiary arm 22 before the sheet supply cassette is installed into the apparatus main body 20 in the case when "OTHER" is selected in the dial 31.

In FIG. 13, the n (herein, 4) switch levers 211 of the detection switch 21 are defined as the switches S1, S2, S3 and S4 in order from above. In addition, a convex part 313*a* that has been positioned at the highest in FIG. 8 of the plurality of convex parts 313*a* of the dial projection part 313 of the dial 31 faces a lower end switch lever 211 (switch S4) of the detection switch 21.

In the state in which the sheet supply cassette 30 is not installed into the apparatus main body 20, none of the switch levers 211 of the detection switch 21 are pushed since the dial projection part 313 of the dial 31 does not reaches the subsidiary arm 22 (contact parts 222). That is, the switches S1, S2, S3 and S4 are OFF.

The controller 100 of the image forming apparatus 10 determines that the sheet supply cassette 30 is not installed in the case when all of the switches S1, S2, S3 and S4 are OFF.

Figure 14:
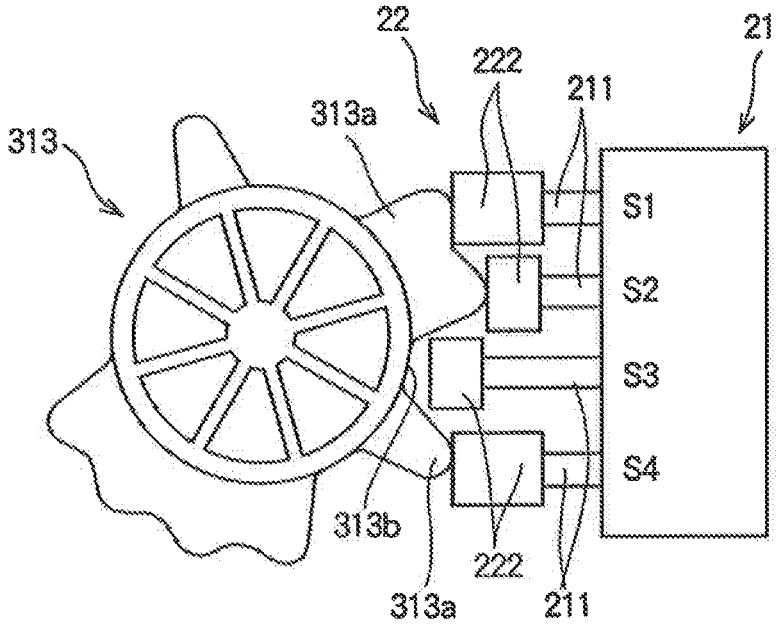
FIG. 14 illustrates the relationship among the dial, the detection switch, and the subsidiary arm after the sheet supply cassette is installed into the apparatus main body.

FIG. 14 illustrates the relationship among the dial 31, the detection switch 21, and the subsidiary arm 22 when the sheet supply cassette 30 is installed into the apparatus main body 20 from the state of FIG. 13.

As shown in FIG. 14, when the sheet supply cassette 30 is installed into the apparatus main body 20, the dial projection part 313 of the dial 31 selectively contacts the contact parts 222 of the subsidiary arm 22, and selectively pushes each of the switch levers 211 of the detection switches 21.

When the dial 31 is at a rotation angle shown in FIG. 14, each of the switch levers 211 (switches S1, S2, S3 and S4) of the detection switch 21 faces, respectively, the convex part, convex part, concave part and convex part of the dial projection part 313 via the contact parts 222 of the subsidiary arm 22. Accordingly, the switch levers 211 that correspond to the switches S1, S2 and S4 (first switch, second switch and fourth switch from above) of the detection switch 21 are pushed. That is, the switches S1, S2 and S4 are ON state, and the switch S3 remains OFF state.

The controller 100 of the image forming apparatus 10 determines that media with nonstandard sizes are accommodated in the sheet supply cassette 30 in the case when the switches S1, S2, S3 and S4 are ON state, ON state, OFF state and ON state.

Here, the case when the media with nonstandard sizes are accommodated in the sheet supply cassette 30 is explained. However, detection of the medium sizes is performed in the same manner as described above even when media with the other medium sizes are accommodated.

As described above, in accordance with the combinations of ON/OFF states of the switches S1, S2, S3 and S4 that corresponds to the four switch levers 211 of the detection switch 21, the $(2^n-1)$, (herein, 15) types of medium sizes are detected and the installation of the sheet supply cassette 30 is determined.

FIG. 12 illustrates setting examples of the cases in which the dial 31 is rotated at intervals of 24 $(360/(2^n-1))$ degrees in FIG. 13 in the clockwise direction when the rotation angle of the dial 31 illustrated in FIG. 13 is defined as 0 degrees (rotation reference).

In addition, as illustrated in FIG. 13, protrusion amounts (protrusion amounts to the dial 31 side) of the contact parts 222 of the upper and lower end arm parts 221 of the subsidiary arm 22 are larger than protrusion amounts of the contact parts 222 of the two center arm parts 221. This is because the dial projection part 313 largely sticks out in the detection switch 21 side at the center than at the upper and lower ends since the dial projection part 313 contacts the subsidiary arm 22 in the rotation radial direction.

As explained above, in the first embodiment of the present invention, the dial projection part 313 of the dial 31 provided on the sheet supply cassette 30 includes the plurality of projection parts (convex parts) 313*a* in the circumferential direction thereof, and is configured to push the switch levers 211 of the detection switch 21 via the subsidiary arm 22 with one or more projection parts 313*a* in accordance with the rotation angles. Therefore, many medium sizes are detected with a compact apparatus configuration.

In particular, downsizing of the image forming apparatus 10 is realized since a shaft direction size of the dial 31 is smaller in comparison with the case when a number of projections are provided in the shaft direction of a drum-shaped member as the conventional art.

In addition, failure of pushing of the detection switch 21 by the dial projection part 313 is prevented since the dial projection part 313 is configured to push the detection switch 21 via the subsidiary arm 22. That is, even if each of the switch levers 211 of the detection switch 21 is a thin pin-shaped member, that switch levers 211 are reliably pushed. As a result, a medium size is reliably detected, for example.

Second Embodiment

Figure 15:
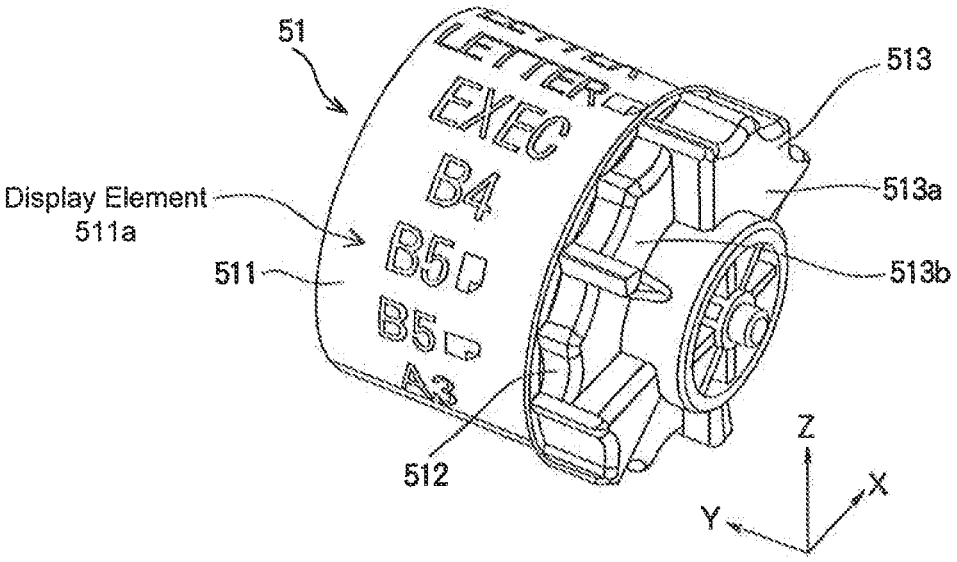
FIG. 15 is a perspective view of a configuration of a dial according to a second embodiment of the present invention.
Figure 16:
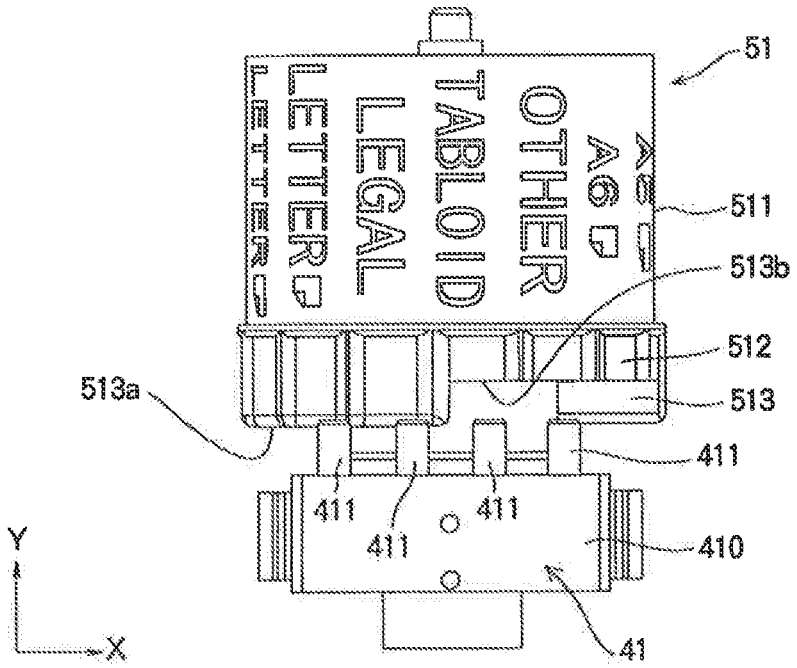
FIG. 16 illustrates the dial and a detection switch according to the second embodiment of the present invention.

Next, a second embodiment of the present invention is explained. FIG. 15 is a perspective view of a dial 51 according to the second embodiment. As illustrated in FIG. 15, the difference of the dial 51 of the second embodiment from the dial 31 of the first embodiment is that a dial projection part 513 is integrally formed with a rotation lock part 512.

The dial projection part 513 is formed as a projection formation part that protrudes in a direction (Y direction) of a rotation shaft of the dial 51 from an end surface of the rotation lock part 512. A front surface (end surface parallel to the XZ surface) of the dial projection part 513 in the Y direction is a contact surface that contacts a subsidiary arm 42 to push a detection switch 41.

In the dial projection part 513, projection parts (convex parts) 513*a* that protrude in the Y direction and depression parts (concave part) 513*b* are arranged in a manner as the patterns illustrated in Table 1 of the first embodiment, for example. A configuration of a display part 511 of the dial 51, including display elements 511*a*, is similar to the display part 311 of the first embodiment.

As illustrated in 16, the detection switch 41 is located to face the dial projection part 513 of the dial 51 in the Y direction. The detection switch 41 includes n switch levers 411 of which pushing directions are in the Y direction. That is, each of the switch levers 411 of the detection switch 41 is pushed in a direction of the rotation shaft of the dial 51.

Figure 17:
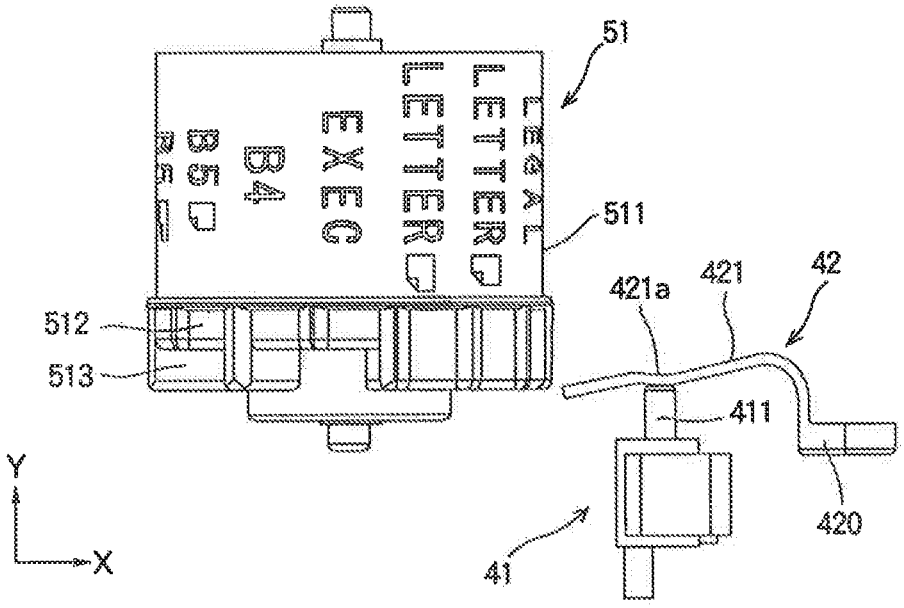
FIG. 17 illustrates configurations and functions of the dial, the detection switch, and the subsidiary arm according to the second embodiment of the present invention.
Figure 18:
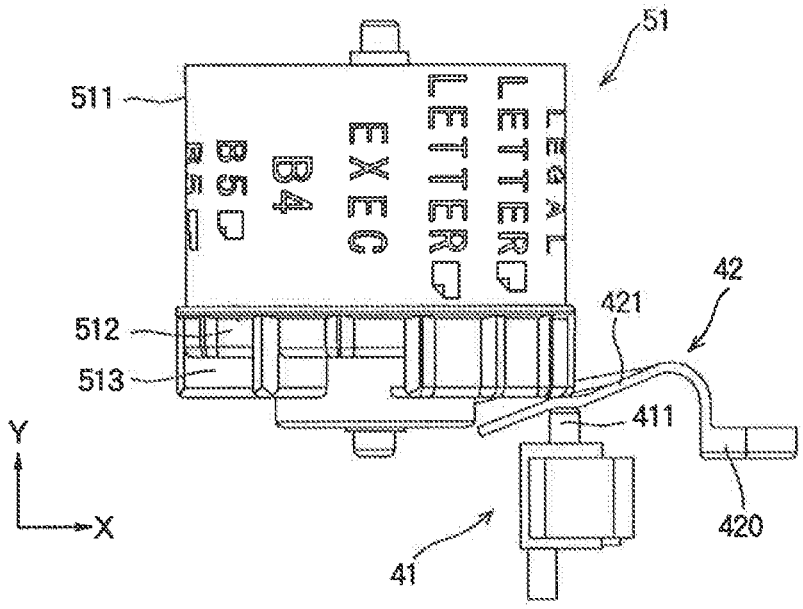
FIG. 18 illustrates the configurations and the functions of the dial, the detection switch, and the subsidiary arm according to the second embodiment of the present invention.

FIGS. 17 and 18 illustrate configurations and functions of the dial 51, the detection switch 41, and the subsidiary arm 42.

The subsidiary arm 42 includes n arm parts 421 that correspond to each of the switch levers 411 and an arm support body 420 that is positioned at +X side of the arm parts 421. The arm parts 421 extend in the substantial X direction, and are configured to be elastically deformable (bendable).

Contact parts 421*a* that contact end parts of the switch levers 411 are formed in the arm parts 421. In addition, the extension direction of the arm parts 421 inclines at a predetermined angle to the X direction. When the dial 51 moves in the +X direction, the dial projection part 513 contacts the arm parts 421, reaches the contact parts 421*a* while the dial projection part 513 elastically deforms the arm parts 421, and pushes the switch levers 411 to which the dial projection part 513 corresponds.

Next, a medium detection operation of the second embodiment is explained.

As illustrated in FIG. 17, in the state in which the sheet supply cassette 30 is not installed into the apparatus main body 20, the dial projection part 513 does not reach the subsidiary arm 42, and none of the switch levers 411 of the detection switch 41 are pushed (OFF state). Thereby, the controller 100 of the image forming apparatus 10 determines that the sheet supply cassette 30 is not installed.

Meanwhile, as illustrated in FIG. 18, when the sheet supply cassette 30 is installed into the apparatus main body 20, the dial projection part 513 of the dial 51 contacts the arm parts 421 of the subsidiary arm 42, reaches the contact parts 421*a* while the dial projection part 513 bends the arm parts 421, and pushes the switch levers 411 to which the dial projection part 513 corresponds.

As explained in the first embodiment (see FIG. 11), based on the combinations of ON/OFF states of the n (herein, 4) switch levers 411, the controller 100 of the image forming apparatus 10 detects the medium size of the media that are accommodated in the sheet supply cassette 30.

As explained above, according to the second embodiment, many medium sizes are detected with a compact apparatus configuration in the same manner as the first embodiment.

Moreover, the detection switch 41 and the subsidiary arm 42 are located in the direction of the rotation shaft (Y direction) to the dial 51. Therefore, freedom degree of location of the detection switch 41 and the subsidiary arm 42 in the apparatus main body 20 is improved.

The printer is explained in the above-discussed first and second embodiments. However, the present invention may be applied in devices, such as facsimile devices, photocopy machines, multifunctional peripherals and the like, that perform some treatments to media, for example. In addition, the media are not limited to sheets and may be other media (e.g. OHP sheet).

What is claimed is:

1. A medium supply device, comprising:

a medium cassette that accommodates a medium and that is installed into a predetermined installation part;

a dial that is provided on the medium cassette and that is rotatable around a predetermined rotation axis;

a position-holding part that is configured to hold the dial at a predetermined rotation position;

an arm member that is provided to face the dial of the medium cassette that is installed on the installation part and that includes a plurality of arm parts that are independent of each other and that are independently displaceable; and a detection switch that includes a plurality of switch parts that are pressed by the plurality of arm parts of the arm member, wherein the dial includes a display part on which a plurality of display elements that illustrate a medium type are arranged in a circumferential direction around the predetermined rotation axis, a rotation engagement member that is configured to be engaged by the position-holding part, and a projection formation part that includes a plurality of projection parts configured to press the plurality of arm parts of the arm member in a circumferential direction around the predetermined rotation axis, the projection parts of the projection formation part selectively contact and displace the arm parts of the arm member in accordance with the rotation position of the dial to selectively press the switch parts of the detection switch, the display part, the rotation engagement member and the projection formation part are integrally combined in an axial direction of the predetermined rotation axis, and the rotation enegagement member forms a plurality of engaged parts that are engageable with an engagement part of the position-holding part and that are positioned in the circumferential direction around the predetermined rotation axis at an even interval.

2. The medium supply device according to claim 1, wherein the predetermined rotation axis of the dial is arranged in a horizontal direction.

3. The medium supply device according to claim 1, wherein a position at which the projection parts of the projection formation part contact the arm parts varies in accordance with the rotation position of the dial.

4. The medium supply device according to claim 1, wherein the plurality of switch parts of the detection switch are arranged to be pressed in a direction substantially parallel to a direction in which the medium cassette is inserted into the installation part.

5. The medium supply device according to claim 4, wherein the plurality of projection parts of the dial protrude in a radial direction of the dial.

6. The medium supply device according to claim 1, wherein the plurality of switch parts of the detection switch are arranged to be pressed in a direction substantially parallel to the predetermined rotation axis of the dial.

7. The medium supply device according to claim 6, wherein the plurality of projection parts of the dial protrude in the axial direction of the predetermined rotation axis of the dial.

8. The medium supply device according to claim 1, wherein the medium cassette further includes an opening part that is configured to visibly present a part of the display part so that the part of the display part is seen from the outside of the medium cassette.

9. The medium supply device according to claim 1, wherein the plurality of arm parts are arranged along a rotational direction of the dial, the detection switch includes at least a first switch part and a second switch part that are pressed by the dial via the arm member and that are arranged in a direction substantially parallel with the rotational direction of the dial at positions corresponding to corresponding ones of the plurality of arms parts, and the projection formation part includes:

a first projection part that presses the first switch part or the second switch part via the arm member in response to the rotation position of the dial, and a second projection part that is formed apart from the first projection part in the rotational direction of the dial and that presses the first switch part or the second switch part via the arm member in response to the rotation position of the dial.

10. The medium supply device according to claim 9, wherein the first projection part of the dial presses the first switch part via the arm member when the first projection part is at a first position, and presses the second switch part via the arm member when the first projection part is at a second position.

11. The medium supply device according to claim 9, wherein the predetermined rotation axis of the dial is positioned at a substantially center of the arm member in a direction in which the plurality of the arm parts are arranged, the plurality of arm parts each include a contact part that projects towards the projection formation part, and a projection amount of the contact part of an arm part of the plurality of arm parts that is positioned at an end part side in the direction in which the plurality of arm parts are arranged is greater than a projection amount of the contact part of an arm part that is positioned at a center side of the direction in which the plurality of arm parts are arranged.

12. A medium supply device, comprising:

a medium cassette that accommodates a medium and that is installed into a predetermined installation part;

a dial that is provided on the medium cassette and that is rotatable around a predetermined rotation axis;

a position-holding part that is configured to hold the dial at a predetermined rotation position;

an arm member that is provided to face the dial of the medium cassette that is installed on the installation part and that includes a plurality of arm parts that are independent of each other and that are independently displaceable; and a detection switch that includes a plurality of switch parts that are pressed by the plurality of arm parts of the arm member, wherein the dial includes a display part on which a plurality of display elements that illustrate a medium type are arranged in a circumferential direction around the predetermined rotation axis, a rotation engagement member that is configured to be engaged by the position-holding part, and a projection formation part that includes a plurality of projection parts configured to press the plurality of arm parts of the arm member in a circumferential direction around the predetermined rotation axis, the projection parts of the projection formation part selectively contact and displace the arm parts of the arm member in accordance with the rotation position of the dial to selectively press the switch parts of the detection switch, the display part, the rotation engagement member and the projection formation part are integrally combined in an axial direction of the predetermined rotation axis, the plurality of arm parts are arranged along a rotational direction of the dial, the detection switch includes at least a first switch part and a second switch part that are pressed by the dial via the arm member and that are arranged in a direction substantially parallel with the rotational direction of the dial at positions corresponding to corresponding ones of the plurality of arms parts, and the projection formation part includes:

a first projection part that presses the first switch part or the second switch part via the arm member in response to the rotation position of the dial, and a second projection part that is formed apart from the first projection part in the rotational direction of the dial and that presses the first switch part or the second switch part via the arm member in response to the rotation position of the dial, and the first projection part of the dial presses the first switch part via the arm member when the first projection part is at a first position, and presses the second switch part via the arm member when the first projection part is at a second position.

13. The medium supply device according to claim 12, wherein the predetermined rotation axis of the dial is arranged in a horizontal direction.

14. The medium supply device according to claim 12, wherein a position at which the projection parts of the projection formation part contact the arm parts varies in accordance with the rotation position of the dial.

15. The medium supply device according to claim 12, wherein the plurality of switch parts of the detection switch are arranged to be pressed in a direction substantially parallel to a direction in which the medium cassette is inserted into the installation part.

16. The medium supply device according to claim 15, wherein the plurality of projection parts of the dial protrude in a radial direction of the dial.

17. The medium supply device according to claim 12, wherein the plurality of switch parts of the detection switch are arranged to be pressed in a direction substantially parallel to the predetermined rotation axis of the dial.

18. The medium supply device according to claim 17, wherein the plurality of projection parts of the dial protrude in the axial direction of the predetermined rotation axis of the dial.

19. The medium supply device according to claim 12, wherein the medium cassette further includes an opening part that is configured to visibly present a part of the display part so that the part of the display part is seen from the outside of the medium cassette.

20. The medium supply device according to claim 12, wherein the predetermined rotation axis of the dial is positioned at a substantially center of the arm member in a direction in which the plurality of the arm parts are arranged, the plurality of arm parts each include a contact part that projects towards the projection formation part, and a projection amount of the contact part of an arm part of the plurality of arm parts that is positioned at an end part side in the direction in which the plurality of arm parts are arranged is greater than a projection amount of the contact part of an arm part that is positioned at a center side of the direction in which the plurality of arm parts are arranged.

* * * * *